United States Patent [19]

Vogt

[11] 4,426,931

[45] Jan. 24, 1984

[54] DEVICE FOR KEEPING THE LOWER COVERING LAYER OF A TWO-LAYER COVERING ON A PRINTING-PRESS CYLINDER

[75] Inventor: Wilfried Vogt, Walldorf, Fed. Rep. of Germany

[73] Assignee: Heidelberger Druckmaschinen Aktiengesellschaft, Heidelberg, Fed. Rep. of Germany

[21] Appl. No.: 398,552

[22] Filed: Jul. 15, 1982

[30] Foreign Application Priority Data

Jul. 16, 1981 [DE] Fed. Rep. of Germany ..... 3128105

[51] Int. Cl.[3] ..... B41F 27/06

[52] U.S. Cl. ..... 101/415.1

[58] Field of Search ..... 101/415.1, 378, 382

[56] References Cited

U.S. PATENT DOCUMENTS

| | | | |
|---|---|---|---|
| 1,651,924 | 12/1927 | Lichtenstein | 101/415.1 |
| 2,712,789 | 7/1955 | Leeberg | 101/415.1 |
| 3,552,314 | 1/1971 | Skinner | 101/378 |
| 3,874,292 | 4/1975 | Parsley | 101/415.1 |
| 3,882,775 | 5/1975 | Lytle et al. | 101/415.1 |
| 4,090,444 | 5/1978 | Stearns | 101/415.1 |

FOREIGN PATENT DOCUMENTS

| | | | |
|---|---|---|---|
| 2910880 | 9/1980 | Fed. Rep. of Germany | 101/415.1 |
| 144658 | 10/1980 | German Democratic Rep. | 101/415.1 |

*Primary Examiner*—E. H. Eickholt

*Attorney, Agent, or Firm*—Herbert L. Lerner

[57] ABSTRACT

Device for keeping a lower covering layer of a two-layer covering on the cylindrical surface of a printing-press cylinder, the two-layer covering also including an upper covering layer covering the keeping device for the lower covering layer, the keeping device for the lower covering layer comprises a keeper rod having a substantially circular cross section and extending along the length of the printing-press cylinder, the keeper rod being braced at one end and at two axially parallel contact locations against the printing-press cylinder so as to position the keeping device in register and in inherently stable condition in circumferential and lateral directions, and locking pins disposed on and distributed in register-maintaining positions along the length of the keeper rod, the locking pins having respective head ends with different length-to-width ratios in the cross section thereof, the head ends being in cooperative engagement in correspondingly shaped holes formed in the lower covering layer.

8 Claims, 6 Drawing Figures

DEVICE FOR KEEPING THE LOWER COVERING LAYER OF A TWO-LAYER COVERING ON A PRINTING-PRESS CYLINDER

The invention relates to a device for keeping the lower covering layer of a two-layer covering on the cylindrical surface of a printing-press cylinder.

The necessity for applying a two-layer covering to the cylindrical surface of a printing-press cylinder is due to various reasons in printing technology, such as for exactly fixing so-called "format sheets" for the blanket cylinder of an offset printing press, for example. Such format sheets are sheets which have been suitably selected for a very small printing format.

If it is desired to fasten the lower and the upper covering separately, well-known difficulties are experienced especially in the constructive design of the device for keeping or retaining the lower covering on the cylinder, one of those difficulties being with respect to the exactness of the positioning of the lower covering.

Thus, a device for keeping a two-layer covering on a printing-press cylinder has become heretofore from German Published Non-Prosecuted Application (DE-OS) No. 1 611 325, for example, wherein the base layer of the two-layer covering is clamped between two rails. The exact position of the clamping rails of this heretofore known device clamping the base layer is attained by means of conventional heads of cylinder screws projecting into bores formed at the edge of the printing-press cylinder and located at the clamping rails, magnets being provided for keeping the heads of the clamping screws in the bores.

Such a device, however, requires too much space. Moreover, forming the connection between the clamping rails keeping or retaining the base covering is complicated and time-consuming. Determination of the position of the clamping rails is indeed prescribed by the bores formed in the printing-press cylinder wherein the heads of the cylinder screws engage; the exact positioning of the base covering with respect to the clamping rails is nevertheless not assured thereby.

Furthermore, a device has become known heretofore from German Published Prosecuted Application (DE-AS) No. 1 145 185 wherein, to fasten a two-layer covering between two tightening or tensioning rollers, on the one hand, and an elongated slot of the printing-press cylinder, on the other hand, in a recess formed in the printing-press cylinder and having a partly circular cross section, a tightening or tension rod extending parallel to the tightening rollers is provided, the tightening rod having a rotary axis directed towards the middle of the elongated slot formed in the outer casing of the printing-press cylinder. The tightening rod also has a cross section, part of which is circular and presses the lower covering layer, in the clamping position of the tightening rod, against the defining surface of the recess wherein the tightening rod is received, one or two flats being located adjacent the circular part of the cross section. The tightening rod further is formed with an elongated slot passing diametrically therethrough and oriented in alignment with the elongated slot formed in the outer casing of the printing-press cylinder, in the clamping position of the tightening rod, and guides the upper layer of the covering towards the tightening rollers.

The material disadvantages of such a device are that orientation of the lower covering layer must be effected manually which, on the one hand, is very time-consuming and, in the end, moreover, results in failure to obtain absolute accuracy. Due to the manner in which the lower covering layer is tightened and clamped, respectively, by means of a tensioning rod, the latter must itself be especially stable inherently. Finally, fastening of the upper covering layer can present difficulties because the upper covering layer must first be threaded through an elongated slot formed in the fastening device for the lower covering layer.

It is accordingly an object of the invention to provide a device for keeping the lower covering layer of a two-layer covering on the cylindrical surface of a printing-press cylinder which avoids the foregoing disadvantages of heretofore known devices of this general type, and to provide a keeping or holding device having as essential characteristics that it be constructed expressly space-saving and, in order to be able to fasten the lower covering layer quickly to the keeping or holding device, assurance be provided, moreover, that the lower covering layer will always be positioned axially parallel and at a predetermined distance or spacing from the outer edge of the printing-press cylinder.

With the foregoing and other objects in view, there is provided, in accordance with the invention, a device for keeping a lower covering layer of a two-layer covering on the cylindrical surface of a printing-press cylinder, the two-layer covering also including an upper covering layer covering the keeping device for the lower covering layer, the keeping device for the lower covering layer comprising a keeper rod having a substantially circular cross section and extending along the length of the printing-press cylinder, the keeper rod being braced at one end and at two axially parallel contact locations against the printing-press cylinder so as to position the keeping device in register and in inherently stable condition in circumferential and lateral directions, and locking pins disposed on and distributed in register-maintaining positions along the length of the keeper rod, the locking pins having respective head ends with different length-to-width ratios in the cross section thereof, the head ends being in cooperative engagement in correspondingly shaped holes formed in the lower covering layer.

In accordance with another feature of the invention, the keeper rod engages in a wedge-shaped gap defined by an edge of a channel of the printing-press cylinder extending parallel to the axis of the printing-press cylinder and the surface of a tensioning device for the upper covering layer disposed in the cylinder channel, the keeping device being pressed into the wedge-shaped gap by the upper covering layer when the latter is tightened by the tensioning device therefor.

In accordance with a further feature of the invention, the keeper rod of substantially circular cross section is formed with a chordal flat whereon the lower covering layer is disposed, the locking pins distributed along the length of the keeper rod forming, through the intermediary of a reinforcing rail, a positive connection between the keeping device and the lower covering layer.

In accordance with an added feature of the invention, the keeper rod of substantially circular cross section is formed with a chordal flat whereon the lower covering layer is disposed, the locking pins distributed along the length of the keeper rod forming, through holes provided in an intermediate reinforcing rail and disposed in register with the holes formed in the lower covering layer, positive connection between the keeping device and the lower covering layer.

In accordance with an additional feature of the invention, means are provided for turning the locking pins through an angle of substantially 90° about the longitudinal axes thereof for positively locking the lower covering layer to the keeper rod.

In accordance with yet another feature of the invention, the keeper rod has at the ends thereof, respectively, a fixed and a spring-loaded substantially conical pin engaging in corresponding centering holes formed in respective bearer rings of the printing-press cylinder, the locking pins and the lower covering layer, respectively, being spaced a distance from the end of the printing-press cylinder comprising the respective bearer ring wherein the fixed pin is engaged, the spaced distance being defined by the extension of the spring-loaded pin from the keeper rod.

In accordance with yet a further feature of the invention, means are provided for shifting the lower covering layer in axial direction of the printing-press cylinder for forming the positive connection between the keeping device and the lower covering layer.

In accordance with a concomitant feature of the invention, the keeper rod is formed at the ends thereof, respectively, with a cone and with a pin, the cone engaging in a corresponding centering hole formed in a first bearer ring of the printing-press cylinder, the pin being surrounded by and guiding a compression spring and engaging in an elongated groove formed in a second bearer ring of the printing-press cylinder, the elongated groove extending radially to the pin.

Other features which are considered as characteristic for the invention are set forth in the appended claims.

Although the invention is illustrated and described herein as embodied in device for keeping the lower covering layer of a two-layer covering on the cylindrical surface of a printing-press cylinder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
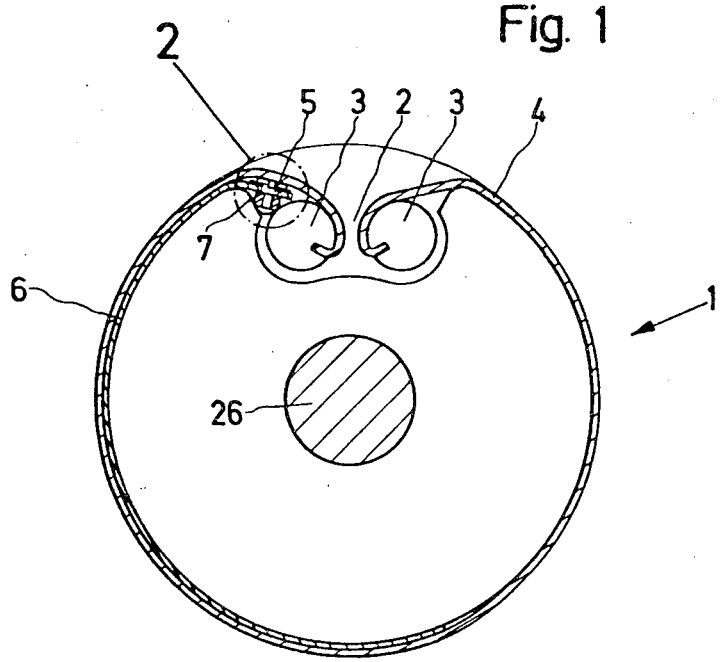
FIG. 1 is a cross-sectional view of a printing-press cylinder showing the device for keeping the lower covering layer of a two-layer covering on the cylindrical surface of the cylinder in accordance with the invention.

Referring now to the drawings and first, particularly, to FIG. 1 thereof, there is shown a printing-press cylinder 1 formed with a channel 2 at the periphery thereof wherein, in general, two tensioning or tightening devices 3 for an upper or outer covering layer 4 of a two-layer covering of the cylinder 1 are received. A device 5 for keeping a lower or inner covering layer 6 of the two-layer covering on the cylindrical surface of the cylinder 1, in accordance with the invention, is disposed within a space defined by the upper or outer covering layer 4, the tensioning or tightening device 3 therefor and an edge or wall surface 7 of the channel 2. In this embodiment of the invention, the lower covering layer 6 itself does not extend around the entire periphery of the printing-press cylinder 1, as is clearly seen in FIG. 1.

Figure 2:
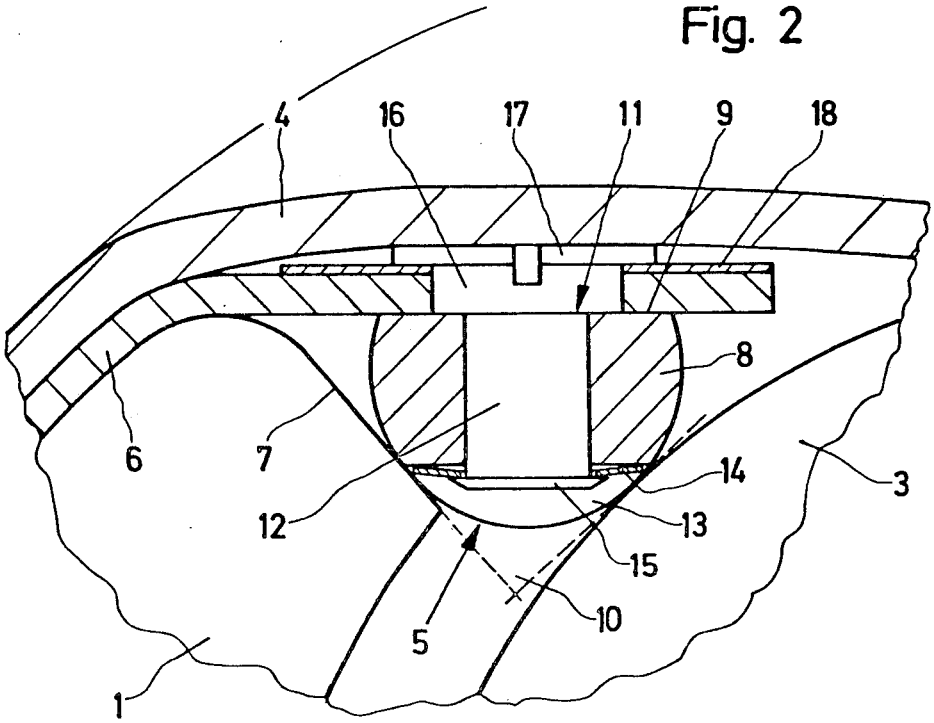
FIG. 2 is an enlarged fragmentary view of FIG. 1 showing details of the keeping device appearing within the circle represented in phantom.

As shown in FIG. 2, the keeping device 5 is mainly formed of keeper rod or rail 8 which extends along the entire length of the printing-press cylinder 1 and has a substantially circular or round cross section formed with a chordal flat 9 whereon the lower covering 6 lies. The entire keeping device 5 together with the lower covering layer 6 fastened thereto is positioned axially parallel with the printing-press cylinder 1 by means of the wedge-shaped gap 10 defined by the edge or wall 7 and the tightening or tensioning device 3 for the upper covering layer 4, and is pressed additionally by the tensioned or tightened upper cover layer 4 into this position.

Figure 4:
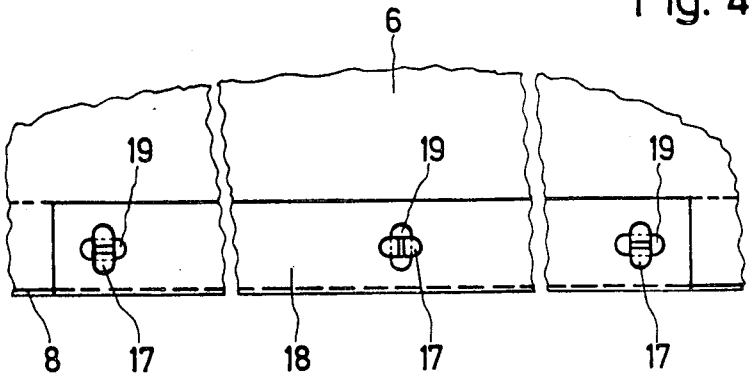
FIG. 4 is a fragmentary plan view of FIG. 3 as seen from above in the latter figure.

The lower covering layer 6 and the keeping device 5 are connected by locking pins 11 provided on the keeper bar 8. Each locking pin 11 has a shaft 12 projecting through a corresponding bore formed in the keeper bar 8 and is turnable about the longitudinal axis thereof. The keeper bar 8 is provided with a cut-out 13 at a location thereof at which the locking pin 11 protrudes therefrom. A cup or plate spring 13, which engages a collar 15 provided at the end of the shaft of the locking pin 11, has the function of maintaining suitable contact of the locking pin head 16 of cylindrical cross section against the chordal flat 9 of the keeper rod 8. The locking pin head 16 has an upper or outer head end 17 selectively formed in the embodiment of FIG. 4 as a round-ended double edge elongated member as shown; for suitable functioning of the upper head end 17, an essential general criterion is that it have a length-to-width ratio in cross section which is different from unity i.e. a length and a width which differ from one another.

The lower covering layer 6 as well as a reinforcing rail or strip 18 provided intermediate the upper head end 17 of the locking pin 11 and the lower covering layer 6 are formed with punch-holes 19 in prescribed locations having a cross section which corresponds to that of the upper head end 17. To form the connection between the keeping device 5 and the lower covering layer 6, the latter is placed over the upper head ends 17 of the locking pins 11 so that the head ends 17 slip through the corresponding holes formed in the lower covering layer 6 and the latter makes contact with the chordal flat 9 formed on the locking pin 11. By means of a screwdriver or other suitable tool, which is introduced into the central kerf formed in the upper head ends 17, the locking pins 11 are turned through an angle of about 90° resulting in a positive or form-locking tightened connection. The reinforcing rail 18 prevents tearing of the lower covering layer 6 at the locations at which it is gripped or clamped by the locking pins 11. No necessity exists, for proper functioning of the device according to the invention, that the reinforcing rail or strip 18 extend along the entire length of the cylinder 1 and that the locking pins 11 be distributed along the entire length of the cylinder 1, respectively.

Figure 3:
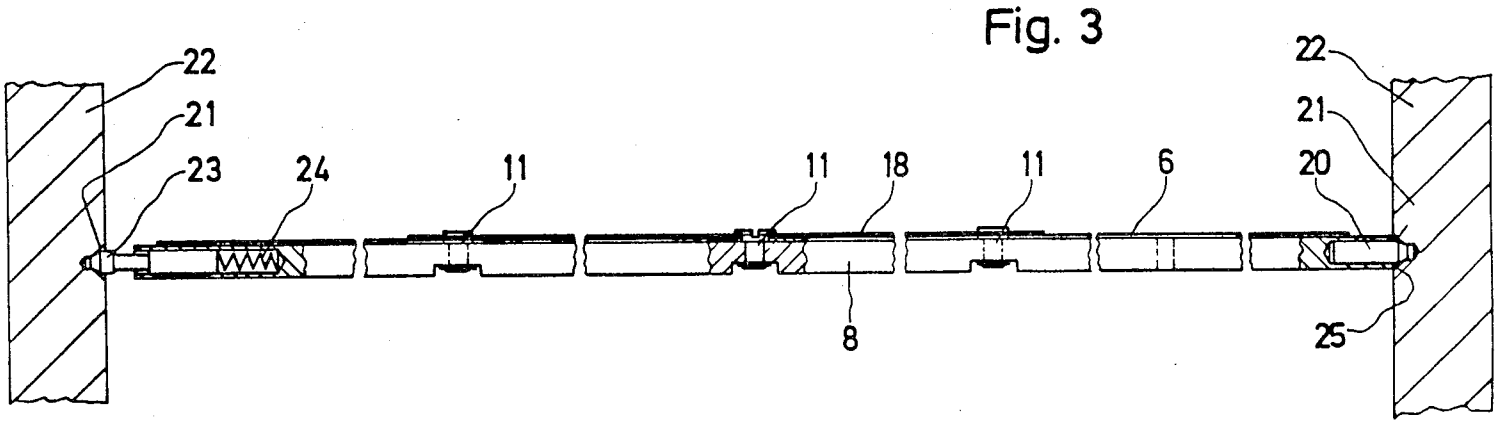
FIG. 3 is a much-reduced axial view, partly broken away and partly in section, of the keeping device of FIGS. 1 and 2 as mounted in end bearer or Schmitz rings of the printing-press cylinder.

The connection between the printing-press cylinder 1 and the keeping device 5 is effected at the ends thereof. A conical pin 20 projecting from the keeper rod 8 is introduced into a centering bore 2 formed in a bearing or Schmitz ring 22 of the printing-press cylinder 1 in the embodiment of FIG. 3. Another conical pin 23 provided at the opposite end of the keeper rod 8 is introduced into a corresponding centering bore 21 of the other bearing or Schmitz ring 22 of the printing-press cylinder 1 and is braced by means of a spring 24 against the keeper rod 8. What is essential is that the distance or spacing between the end 25 of the keeper rod 8 provided with the fixed conical pin 23 to the locking pin 11 is defined, and assurance is thereby provided that, together with the punch-holes 19 likewise provided in the prescribed position, the lower covering layer 6 lies exactly at the desired location on the printing-press cylinder 1.

Figure 5:
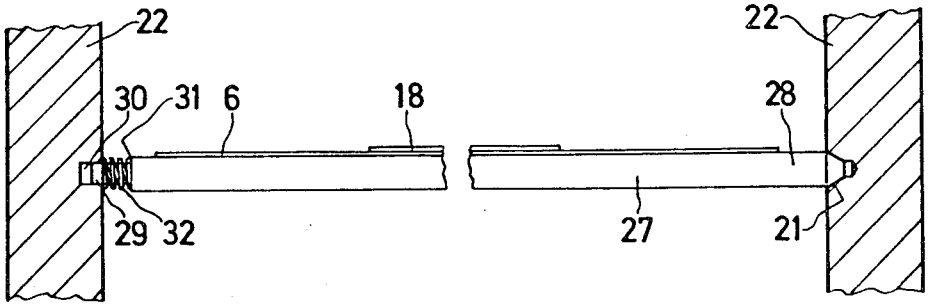
FIG. 5 is a view similar to that of FIG. 3 of another embodiment of the invention.

Another embodiment of the keeper rod 27 with end fasteners is shown in FIG. 5. In this embodiment, the keeper rod 27 is able to be provided with an even smaller cross-sectional dimension because, due to the inherently stabilizing support or bracing thereof at the two axially parallel contact locations 3 and 7, no regard need be given to its own inherent stability. One end of the keeper bar 27 is provided with a cone 28 which engages in the centering bore 21 formed in the bearer or Schmitz ring 22. The other end of the keeper bar 27 is provided with a pin 29 which, in turn, engages in a corresponding recess 30 formed in the other bearer or Schmitz ring 22. To provide an improved assembly of the keeper rod 27, the recess 30 may advantageously be formed as an elongated slot extending radially to the axis of the Schmitz ring 22. A compression spring 32 disposed on the pin 29 and braced against a shoulder 31 as well as the Schmitz ring 22 ensures the lateral positioning of the keeper bar 27 which is defined by the seat of the cone 28.

Figure 6:
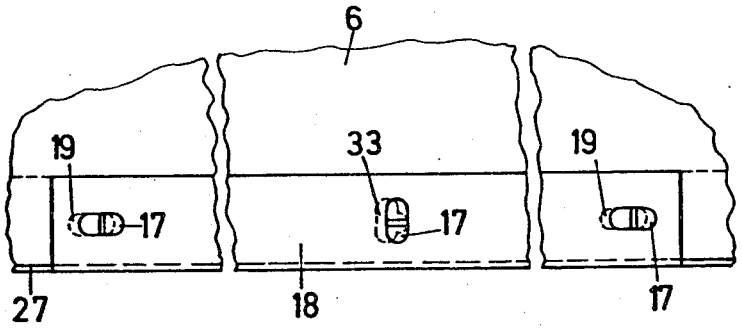
FIG. 6 is a view similar to that of FIG. 4 of the embodiment shown in FIG. 5 illustrating another manner of effecting a positive tightening connection.

Finally, there is another possible manner in which the clamping or tensioning connection for the lower covering layer 6 may be produced in a relatively simple manner. In this regard, reinforcing rails or strips 18 as well as the lower covering layer 6 are provided with punch-holes 19 and 33, as shown in FIG. 6. To assemble the lower covering layer 6, it is passed over the upper head ends 17 of the locking pins 11 and brought into contact with the chordal flat 9 of the keeper rod 27. Then, the lower covering layer 6 is somewhat laterally shifted until it comes into contact with the shaft 12 of each locking pin 11 at the edge of the appertaining punch-hole 19 and 33. The upper head end 17 thus overlaps the punch holes 19 and 33 so that the tightened or clamped connection is produced.

There are claimed:

1. Device for keeping a lower covering layer of a two-layer covering on the cylindrical surface of a printing-press cylinder, the two-layer covering also including an upper covering layer covering the keeping device for the lower covering layer, the keeping device for the lower covering layer comprising a keeper rod having a substantially circular cross section and extending along the length of the printing-press cylinder, said keeper rod being braced at one end and at two axially parallel contact locations against the printing-press cylinder so as to position the keeping device in register and in inherently stable condition in circumferential and lateral directions, and locking pins disposed on and distributed in register-maintaining positions along the length of the keeper rod, said locking pins having respective head ends with different length-to-width ratios in the cross section thereof, said head ends being in cooperative engagement in correspondingly shaped holes formed in the lower covering layer.

2. Keeping device according to claim 1 wherein said keeper rod engages in a wedge-shaped gap defined by an edge of a channel of the printing-press cylinder extending parallel to the axis of the printing-press cylinder and the surface of a tensioning device for the upper covering layer disposed in the cylinder channel, the keeping device being pressed into said wedge-shaped gap by the upper covering layer when the latter is tightened by the tensioning device therefor.

3. Keeping device according to claim 1 wherein said keeper rod of substantially circular cross section is formed with a chordal flat whereon the lower covering layer is disposed, said locking pins distributed along the length of said keeper rod forming, through the intermediary of a reinforcing rail, a positive connection between the keeping device and the lower covering layer.

4. Keeping device according to claim 1 wherein said keeper rod of substantially circular cross section is formed with a chordal flat whereon the lower covering layer is disposed, said locking pins distributed along the length of said keeper rod forming, through holes provided in an intermediate reinforcing rail and disposed in register with said holes formed in the lower covering layer, positive connection between the keeping device and the lower covering layer.

5. Keeping device according to claim 1 including means for turning said locking pins through an angle of substantially 90° about the longitudinal axes thereof for positively locking the lower covering layer to said keeper rod.

6. Keeping device according to claim 1 wherein said keeper rod has at the ends thereof, respectively, a fixed and a spring-loaded substantially conical pin engaging in corresponding centering holes formed in respective bearer rings of the printing-press cylinder, said locking pins and the lower covering layer, respectively, being spaced a distance from the end of the printing-press cylinder comprising the respective bearer ring wherein said fixed pin is engaged, said spaced distance being defined by the extension of said spring-loaded pin from said keeper rod.

7. Keeping device according to claim 3 or 4 including means for shifting the lower covering layer in axial direction of the printing-press cylinder for forming said positive connection between the keeping device and the lower covering body.

8. Keeping device according to claim 1 wherein said keeper rod is formed at the ends thereof, respectively, with a cone and with a pin, said cone engaging in a corresponding centering hole formed in a first bearer ring of the printing-press cylinder, said pin being surrounded by and guiding a compression spring and engaging in an elongated groove formed in a second bearer ring of the printing-press cylinder, said elongated groove extending radically to said pin.

* * * * *